US008850991B2

(12) United States Patent
Early et al.

(10) Patent No.: US 8,850,991 B2
(45) Date of Patent: Oct. 7, 2014

(54) HOPPER CAR GATE ASSEMBLY WITH A DOOR HAVING VERTICALLY SPACED SECTIONS

(75) Inventors: Stephen R. Early, Olathe, KS (US); Brian Early, Lee's Summit, MO (US)

(73) Assignee: Aero Transportation Products, Inc., Independence, MO (US)

( * ) Notice: Subject to any disclaimer, the term of this patent is extended or adjusted under 35 U.S.C. 154(b) by 210 days.

(21) Appl. No.: 13/416,365

(22) Filed: Mar. 9, 2012

(65) Prior Publication Data

US 2013/0233199 A1 Sep. 12, 2013

(51) Int. Cl.
*B61D 3/00* (2006.01)

(52) U.S. Cl.
USPC ..... 105/286; 105/282.3

(58) Field of Classification Search
CPC ..... B61D 7/00; B61D 7/02; B61D 7/20; B61D 7/22; B61D 7/24; B61D 7/26; B61D 7/28; B61D 7/30
USPC ..... 105/281, 282.1, 282.2, 282.3, 283, 286, 105/288
See application file for complete search history.

(56) References Cited

U.S. PATENT DOCUMENTS

| | | | | | |
|---|---|---|---|---|---|
| 3,788,530 | A * | 1/1974 | Adler | 105/282.1 |
| 3,865,046 | A * | 2/1975 | Fuller | 105/253 |
| 3,917,084 | A * | 11/1975 | Swisher et al. | 414/523 |
| 4,344,365 | A * | 8/1982 | Fritz et al. | 105/282.2 |
| 4,359,176 | A * | 11/1982 | Johnson | 105/240 |
| 5,046,432 | A * | 9/1991 | Bowler | 105/282.1 |
| 6,024,023 | A * | 2/2000 | Magolske | 105/282.1 |
| 6,932,433 | B2 * | 8/2005 | Heider et al. | 298/27 |
| 7,171,907 | B2 * | 2/2007 | Early | 105/247 |
| 7,367,271 | B2 * | 5/2008 | Early | 105/282.2 |
| 7,752,979 | B2 * | 7/2010 | Early | 105/282.1 |
| 7,806,057 | B2 | 10/2010 | Early | |
| 7,814,842 | B2 | 10/2010 | Early | |
| 7,819,067 | B2 * | 10/2010 | Early | 105/282.3 |
| 8,371,235 | B1 * | 2/2013 | Early | 105/247 |
| 2001/0015152 | A1 * | 8/2001 | Dohr et al. | 105/282.3 |
| 2009/0235840 | A1 * | 9/2009 | Early | 105/282.3 |
| 2013/0233199 | A1 * | 9/2013 | Early et al. | 105/286 |

OTHER PUBLICATIONS

Martin Engineering Company, *Boot-Lift® Railcar Connector*, Technical Data Sheet, 2011.
Miner Enterprises, Inc., *15×48 AutoLOK II 64 Hole Gate Arrangement*, Mar. 8, 2011.

* cited by examiner

*Primary Examiner* — Jason C Smith
(74) *Attorney, Agent, or Firm* — Stinson Leonard Street LLP

(57) ABSTRACT

A hopper car gate assembly having a frame with opposed side walls, opposed end walls, and top and bottom openings. The gate assembly has a door with a lower section that is supported by the frame and an upper section that is vertically spaced from the lower section. The door is moveable between a closed position, in which the lower section blocks the bottom opening, and an open position, in which cargo can exit through the bottom opening. A drive mechanism engages the upper section of the door to move the door between its closed and open positions. Preferably, the door has a middle section that is joined to and extends upward from the lower section, and the upper section is joined to and extends away from the middle section.

26 Claims, 12 Drawing Sheets

HOPPER CAR GATE ASSEMBLY WITH A DOOR HAVING VERTICALLY SPACED SECTIONS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed toward a hopper car gate assembly and, more particularly, to a hopper car gate assembly with a door having vertically spaced sections.

2. Description of Related Art

Sand used in hydraulic fracturing is commonly transported in a hopper railcar having at least one gravity discharge gate assembly for unloading the sand. When the hopper car reaches its destination, the sand is typically unloaded with a conveyor that extends underneath the hopper car's gate assembly. For the conveyor to fit underneath the gate assembly, there must be a sufficient amount of clearance between the bottom of the gate assembly and the rails over which the hopper car travels.

Hydraulic fracturing sand is commonly transported in a type of hopper railcar that is commonly referred to as a cement car because the car is well adapted for transporting cement. Further, a particular type of gate assembly that is commonly referred to as a cement gate assembly is mounted to the bottom of a cement car to discharge the cargo within the car. A cement gate assembly typically has a top opening that is sized to correspond with the opening in the bottom of a cement car. Further, a cement gate assembly typically has a bottom opening that is sized to correspond with the opening in a cement boot, which is a device that is positioned adjacent to a cement gate assembly during unloading to receive cargo discharged through the gate assembly. A conventional cement car having a conventional cement gate assembly is not typically suitable for hauling hydraulic fracturing sand because the sand unloading conveyor does not fit between the bottom of the gate assembly and the rails over which the car travels.

Two gate assemblies have been developed that mount to the bottom of a conventional cement car and provide the necessary clearance for unloading with a sand conveyor. The first type of gate assembly is similar to a conventional cement gate assembly except that a hopper of the gate assembly is shallower than the hopper of a conventional cement gate assembly so that there is sufficient clearance beneath the gate assembly for unloading with a sand conveyor. The gate assembly has a top opening that is the same as the top opening of a conventional cement gate assembly, and the hopper walls of the gate assembly are angled in the same manner as the hopper walls of a conventional cement gate assembly. Because the gate assembly's hopper is shallower than the hopper of a conventional cement gate assembly and the gate assembly's hopper walls are angled in the same manner as the hopper walls of a conventional cement gate assembly, the bottom opening of the gate assembly is larger than the bottom opening of a conventional cement gate assembly. Because the gate assembly has a larger bottom opening, cargo cannot be unloaded with a conventional cement boot having an opening that is sized to correspond with the smaller bottom opening of a conventional cement gate assembly. Thus, while this first type of gate assembly may be used with a sand unloading conveyor, it is not suitable for use with a hopper car transporting cement.

The second type of gate assembly that provides the necessary clearance for unloading with a sand conveyor is similar to the first type of gate assembly described above, except that the second type of gate assembly includes a structure positioned below the gate assembly's door which is sized so that the gate assembly can mate with and discharge cargo into a conventional cement boot. The structure mounts on or is integral with the gate assembly's frame and includes a top opening that receives cargo passing through the gate assembly's door and a bottom opening that is sized to correspond with the size of a conventional cement unloading boot. The height of the structure is such that there is sufficient clearance for a sand unloading conveyor to fit beneath the gate assembly. While this gate assembly may be unloaded with both a conventional cement boot and a sand conveyor, cargo passing through the gate assembly can accumulate on the structure beneath the door and interfere with the gate assembly's operation.

BRIEF SUMMARY OF THE INVENTION

A hopper car gate assembly in accordance with an embodiment of the present invention includes a frame having opposed side walls coupled with opposed end walls, and top and bottom openings. The gate assembly has a door with vertically spaced upper and lower sections that are supported by the frame. The door is moveable between a closed position, in which the lower section blocks the bottom opening, and an open position, in which cargo can exit through the bottom opening. A drive mechanism engages the upper section of the door to move the door between its closed and open positions.

Due to the vertically spaced upper and lower sections of the door and the drive mechanism engaging the upper section, the height of the frame is preferably such that when the gate assembly is mounted to a conventional cement car there is sufficient clearance beneath the gate assembly to unload the car with a conventional hydraulic fracturing sand unloading conveyor. The top opening of the gate assembly is preferably sized so that the gate assembly may be mounted to a conventional cement hopper car, and the bottom opening of the gate assembly is preferably sized to permit the gate assembly to be unloaded with a conventional cement hopper car unloading boot. It is also within the scope of the present invention for the gate assembly's openings to have different dimensions. The door is also preferably shaped in a manner that increases its structural rigidity.

Preferably, the door has a middle section that is joined to and extends upward from the lower section, and the upper section is joined to and extends away from the middle section. The lower section preferably has a top surface and a bottom surface that is supported by the frame. Preferably, the upper section has top and bottom surfaces, and the bottom surface of the upper section is vertically spaced above the top and bottom surfaces of the lower section. A rack is preferably mounted on the bottom surface of the upper section, and the drive mechanism preferably includes a drive shaft that is supported by the frame and a gear that mounts on the drive shaft and engages the rack. In accordance with one embodiment of the present invention, when the door is in its closed position, the lower section is positioned below the side and end walls and the upper section extends away from the side and end walls such that at least a portion of the upper section intersects a vertical plane that does not intersect the side or end walls.

Additional aspects of the invention, together with the advantages and novel features appurtenant thereto, will be set forth in part in the description that follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
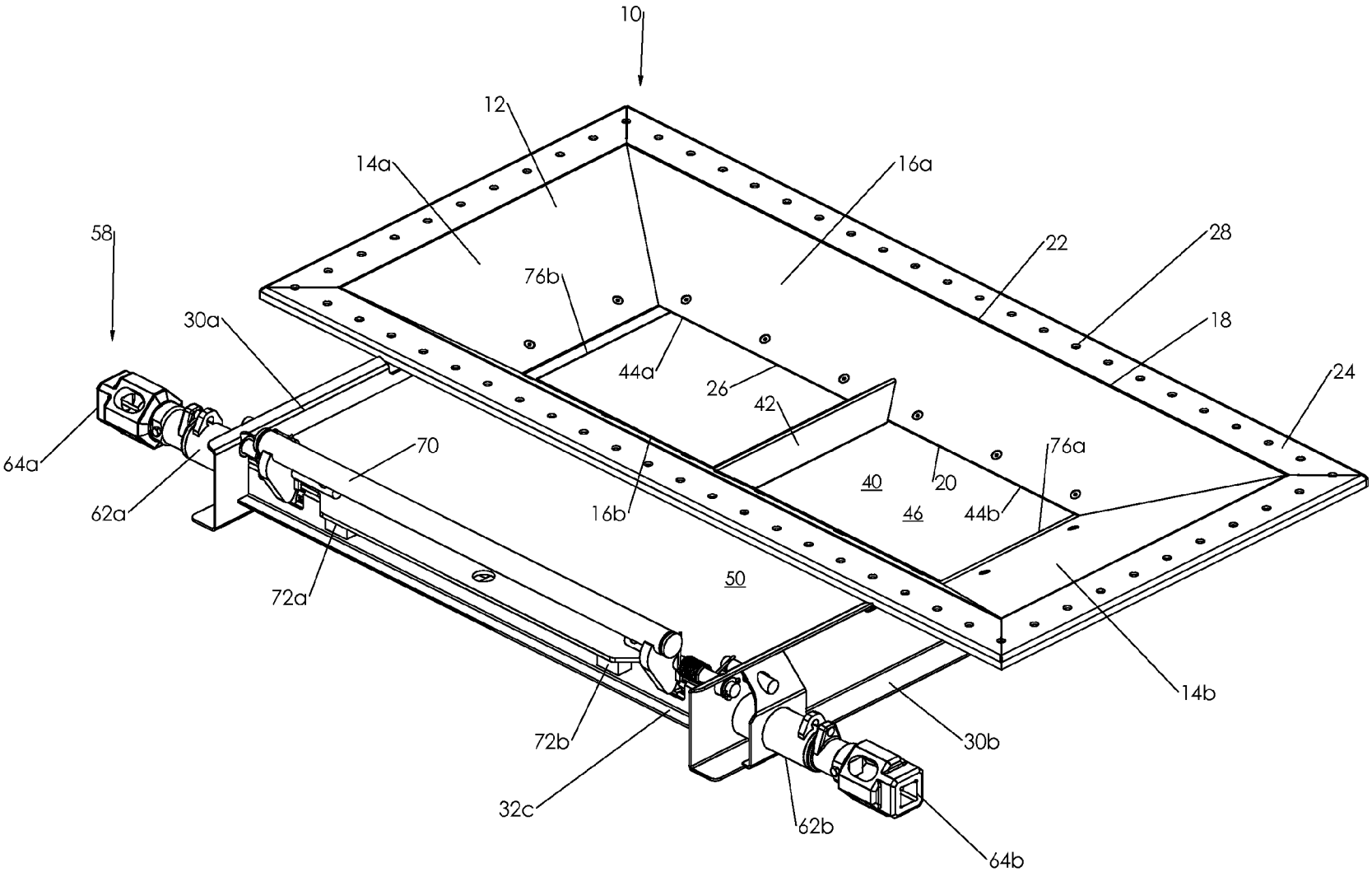
FIG. 1 is a perspective view of a hopper car gate assembly in accordance with the present invention.

A hopper car gate assembly in accordance with the present invention is shown generally in FIG. 1 as 10. The hopper car gate assembly 10 includes a frame 12 with opposed side walls 14*a* and 14*b* each joined with opposed end walls 16*a* and 16*b*. The side and end walls 14*a-b*, 16*a-b* form a hopper and define a top opening 18 and a hopper opening 20 of the gate assembly 10. Walls 14*a-b* and 16*a-b* have an upper edge 22 that surrounds top opening 18 and is joined with a flange 24, and a lower edge 26 that surrounds hopper opening 20. Flange 24 has a plurality of openings 28 that are operable to receive fasteners (not shown) to join the gate assembly 10 to a hopper car (not shown). Preferably, the hopper car has a plurality of hoppers for storing cargo. Each of the hoppers preferably has an opening at the bottom of the car and a rim surrounding the opening. The rim has a plurality of holes that align with the openings 28 in flange 24. The dimensions of flange 24 may vary depending on the type of hopper car to which the gate assembly 10 is mounted.

Figure 7:
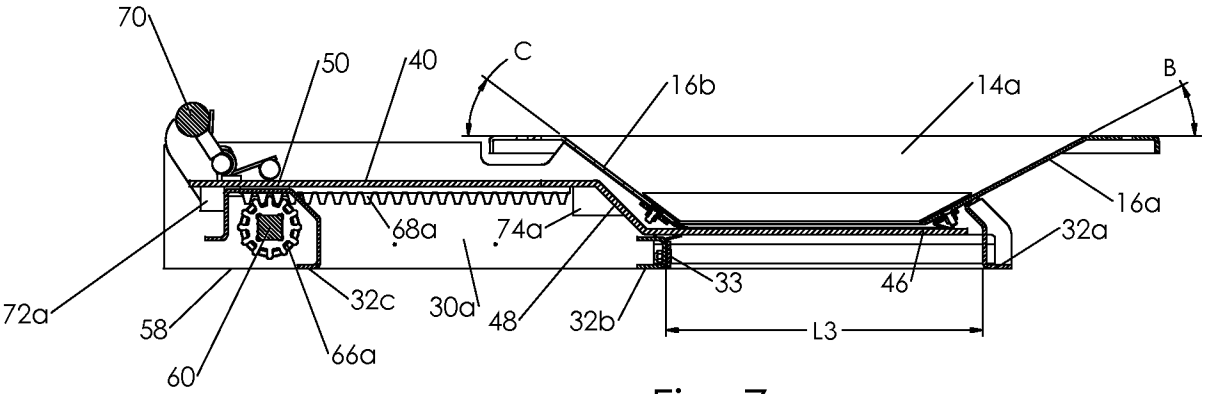
FIG. 7 is a cross-sectional view taken through the line 7-7 in FIG. 4.
Figure 8:
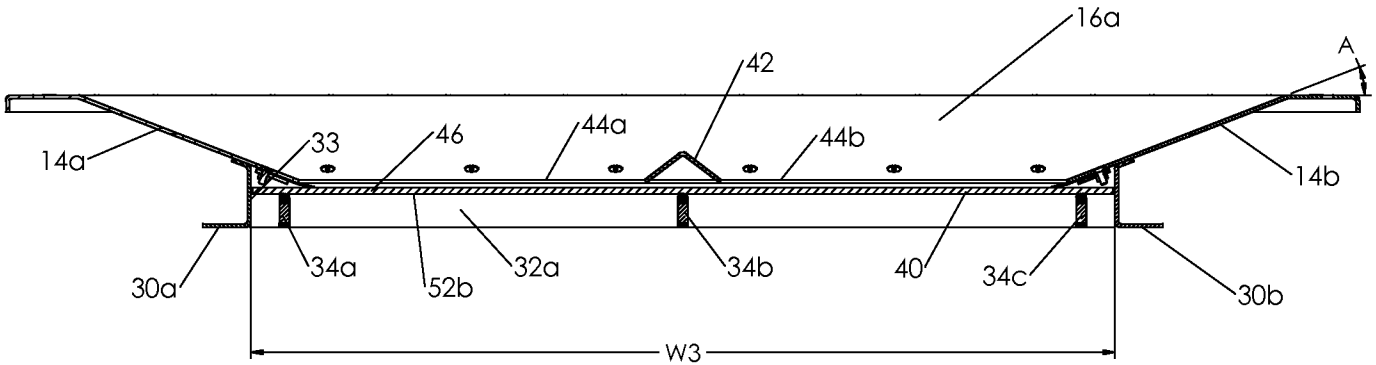
FIG. 8 is a cross-sectional view taken through the line 8-8 in FIG. 2.

As shown in FIG. 8, each of side walls 14*a-b* is positioned at an angle A relative to a horizontal plane, and, as shown in FIG. 7, end walls 16*a-b* are positioned at angles B and C, respectively, relative to a horizontal plane. Angles A-C are preferably between approximately 20 to 55 degrees, and most preferably between approximately 25-40 degrees.

Figure 6:
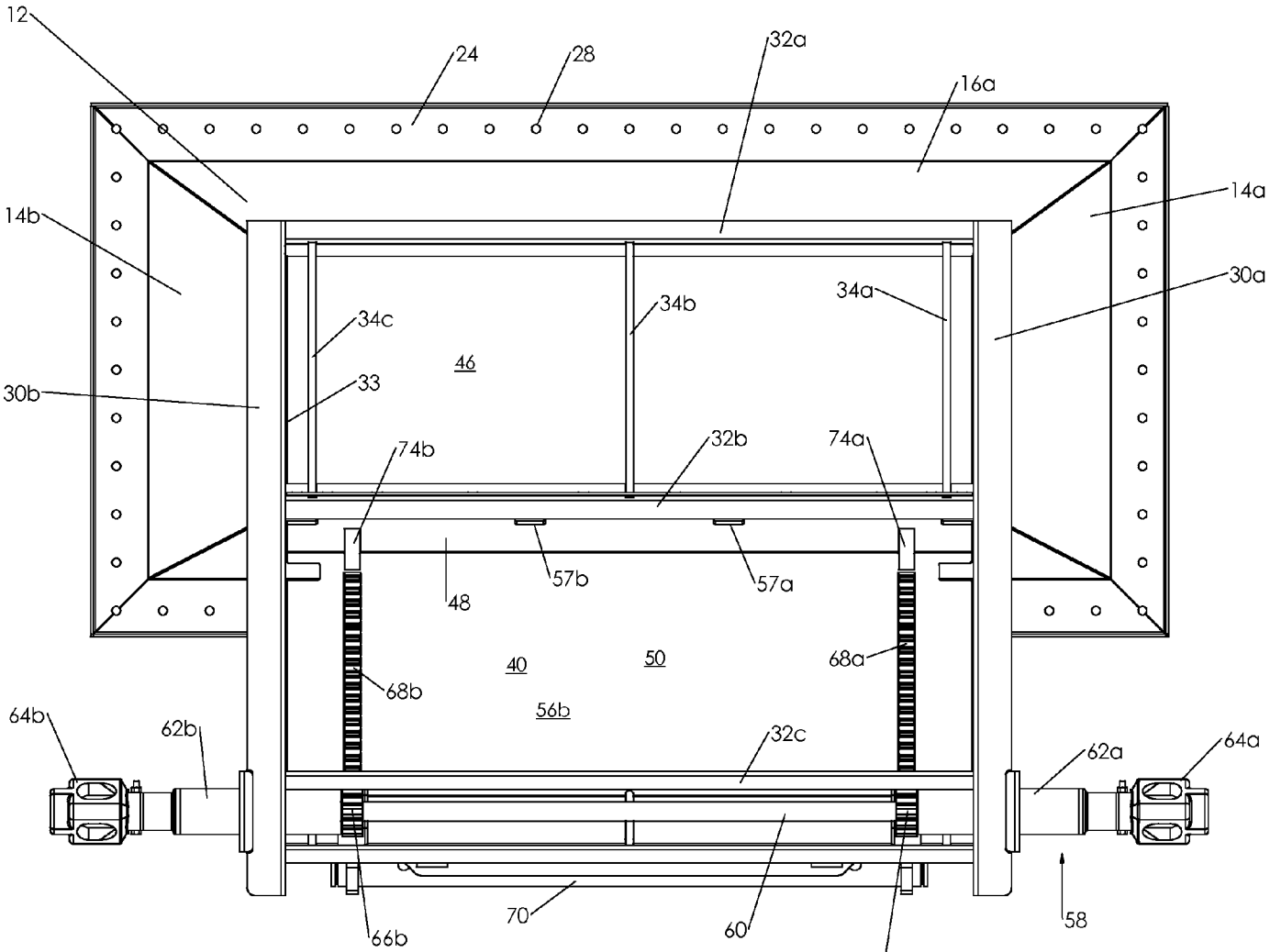
FIG. 6 is a bottom plan view of the gate assembly shown in FIG. 1.
Figure 10:
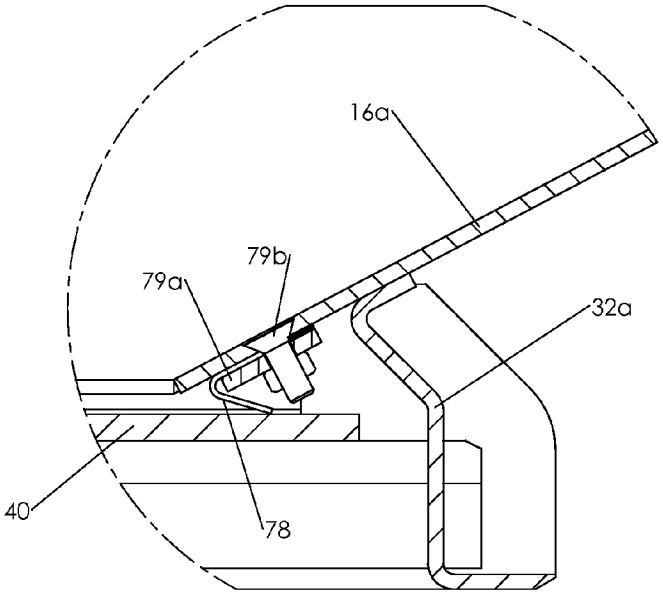
FIG. 10 is a detail view of a connection between an end wall and end frame member of the gate assembly shown in FIG. 1.
Figure 9:
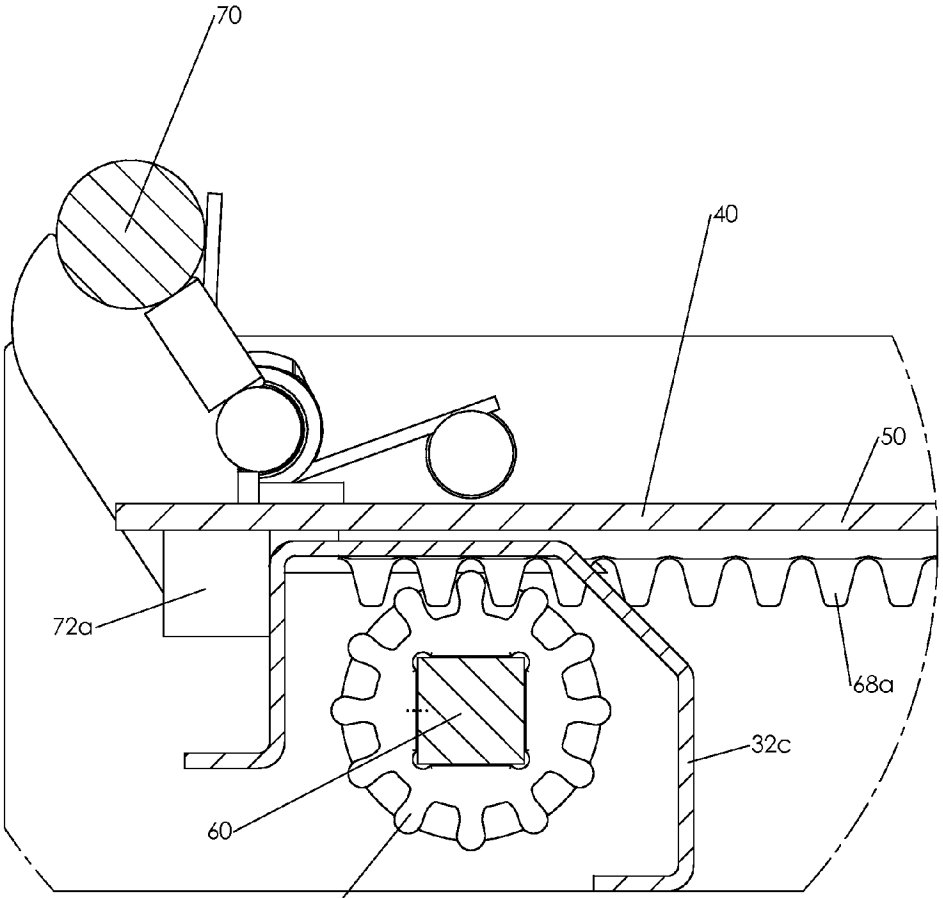
FIG. 9 is a detail view of a gear and rack of the gate assembly shown in FIG. 1.
Figure 12:
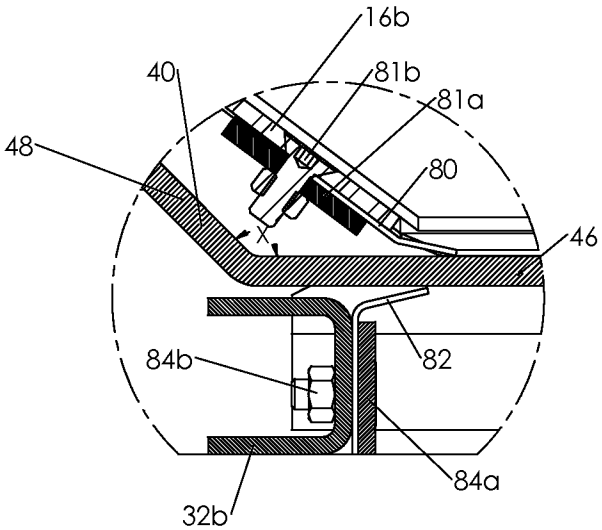
FIG. 12 is a detail view of an end frame member positioned below an end wall of the gate assembly shown in FIG. 1.
Figure 11:
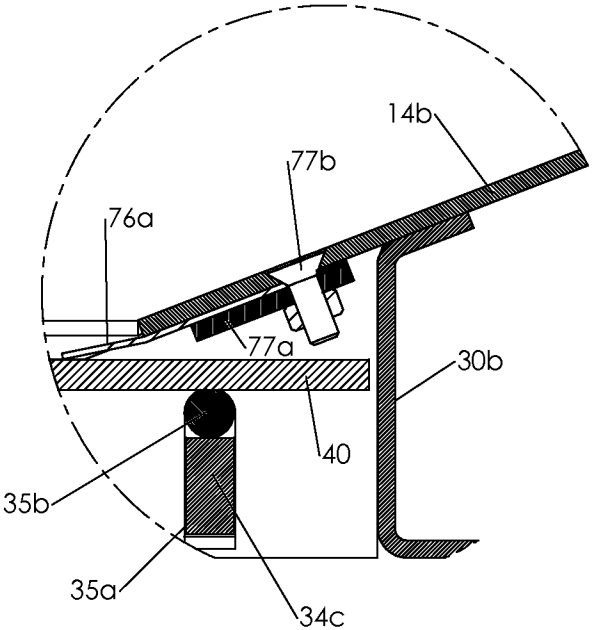
FIG. 11 is a detail view of a connection between a side wall and side frame member of the gate assembly shown in FIG. 1.

Referring to FIG. 6, the frame 12 includes side frame members 30*a* and 30*b*, and first, second, and third end frame members 32*a*, 32*b*, and 32*c* each extending between and joined with the side frame members 30*a* and 30*b*. As best shown in FIG. 11, side wall 14*b* is joined to side frame member 30*b*. Side wall 14*a* is joined to side frame member 30*a* in a similar manner. Referring to FIG. 10, end wall 16*a* is joined with first end frame member 32*a*. As shown in FIG. 12, second end frame member 32*b* is positioned underneath end wall 16*b*, and third end frame member 32*c*, shown in FIGS. 7 and 9, is positioned at the opposite end of the gate assembly 10 from first end frame member 32*a*. The side frame members 30*a-b* and first and second end frame members 32*a-b* define a bottom opening 33 of the gate assembly 10, as shown in FIGS. 6-8.

Figure 3:
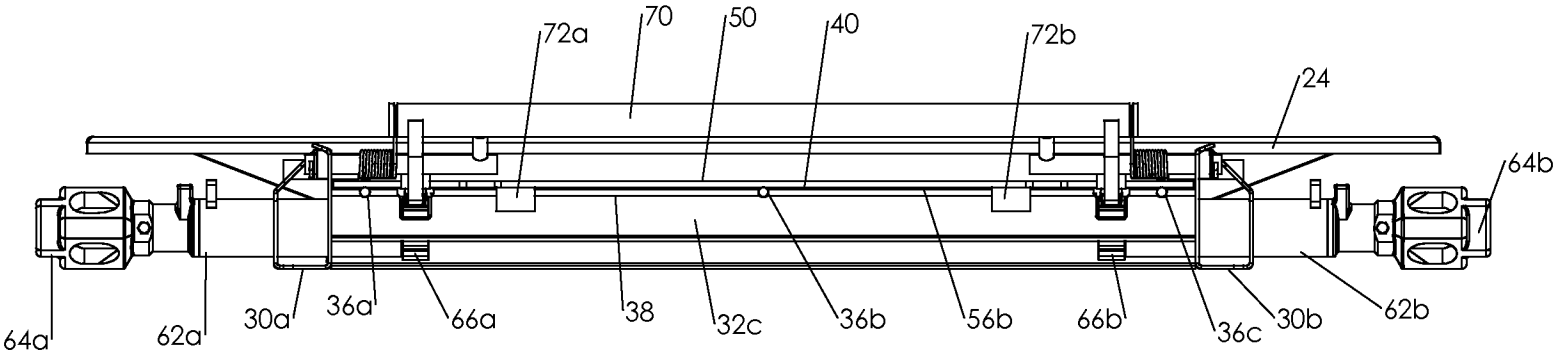
FIG. 3 is a rear elevational view of the gate assembly shown in FIG. 1.
Figure 4:
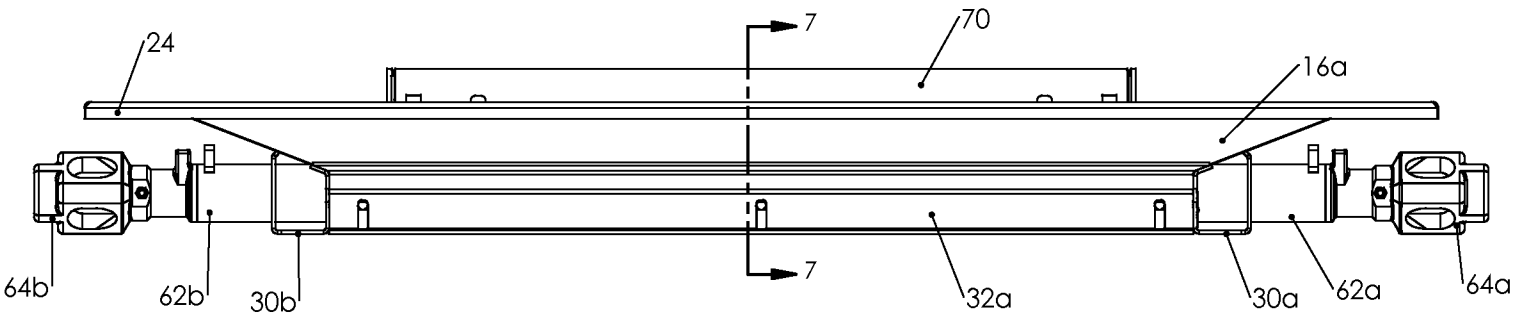
FIG. 4 is a front elevational view of the gate assembly shown in FIG. 1.

A first group of rails 34*a*, 34*b*, and 34*c*, shown in FIG. 6, extend between and are joined with first and second end frame members 32*a* and 32*b*. A second group of rails 36*a*, 36*b*, and 36*e*, shown in FIG. 3, are joined to an upper surface 38 of third end frame member 32*c*. The first and second groups of rails 34*a-c* and 36*a-c* support a door 40. Referring to FIG. 11, rail 34*c* includes a base 35*a* having a rectangular cross-section and a bar 35*b* having a circular cross-section. The door 40 slides over the bar 35*b*, which is preferably constructed of a material with a relatively low coefficient of friction such as bronze. Each of rails 34*a-b* and 36*a-c* has a similar construction as rail 34*c*. In an alternative embodiment, the bar 35*b* may be eliminated and the base 35*a* raised so that the base 35*a* supports the door 40.

Referring to FIG. 1, a rail cover 42 extends between and is joined to each of said end walls 16*a* and 16*b*. The rail cover 42 is positioned above rail 34*b*, as shown in FIG. 8, for diverting cargo away from rail 34*b* when door 40 is opened and stiffen end wall 16*b*. The rail cover 42 divides the hopper opening 20 into two sections 44*a* and 44*b*. Referring to FIG. 8, rails 34*a* and 34*c* are positioned underneath side walls 14*a* and 14*b*, respectively, such that there is a clear, unobstructed passageway through each of the sections 44*a* and 44*b* of hopper opening 20. Gate assembly 10 has no structure positioned directly beneath the sections 44*a* and 44*b* of hopper opening 20 so that cargo can flow through the sections 44*a* and 44*b* unimpeded when the door 40 is opened.

Figure 13:
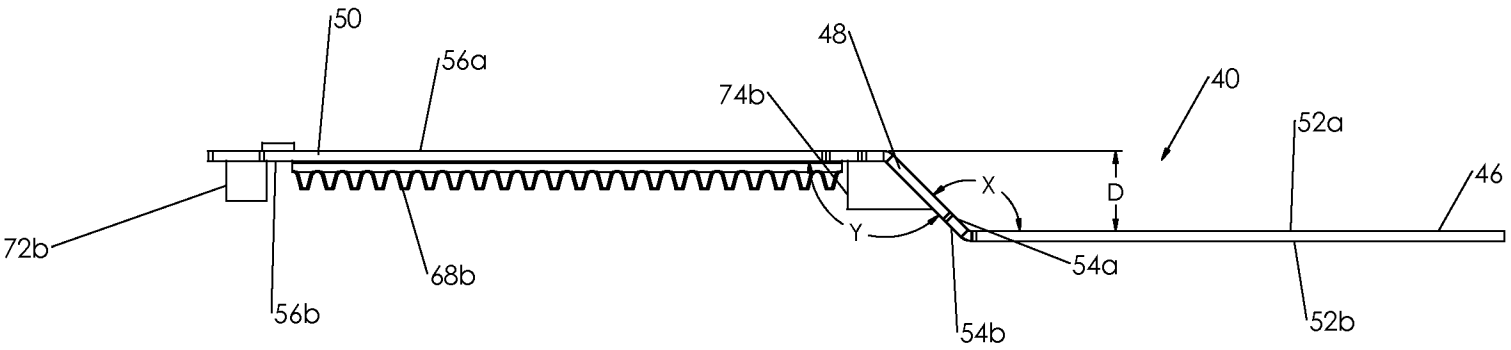
FIG. 13 is a side elevational view of a door of the gate assembly shown in FIG. 1.
Figure 14:
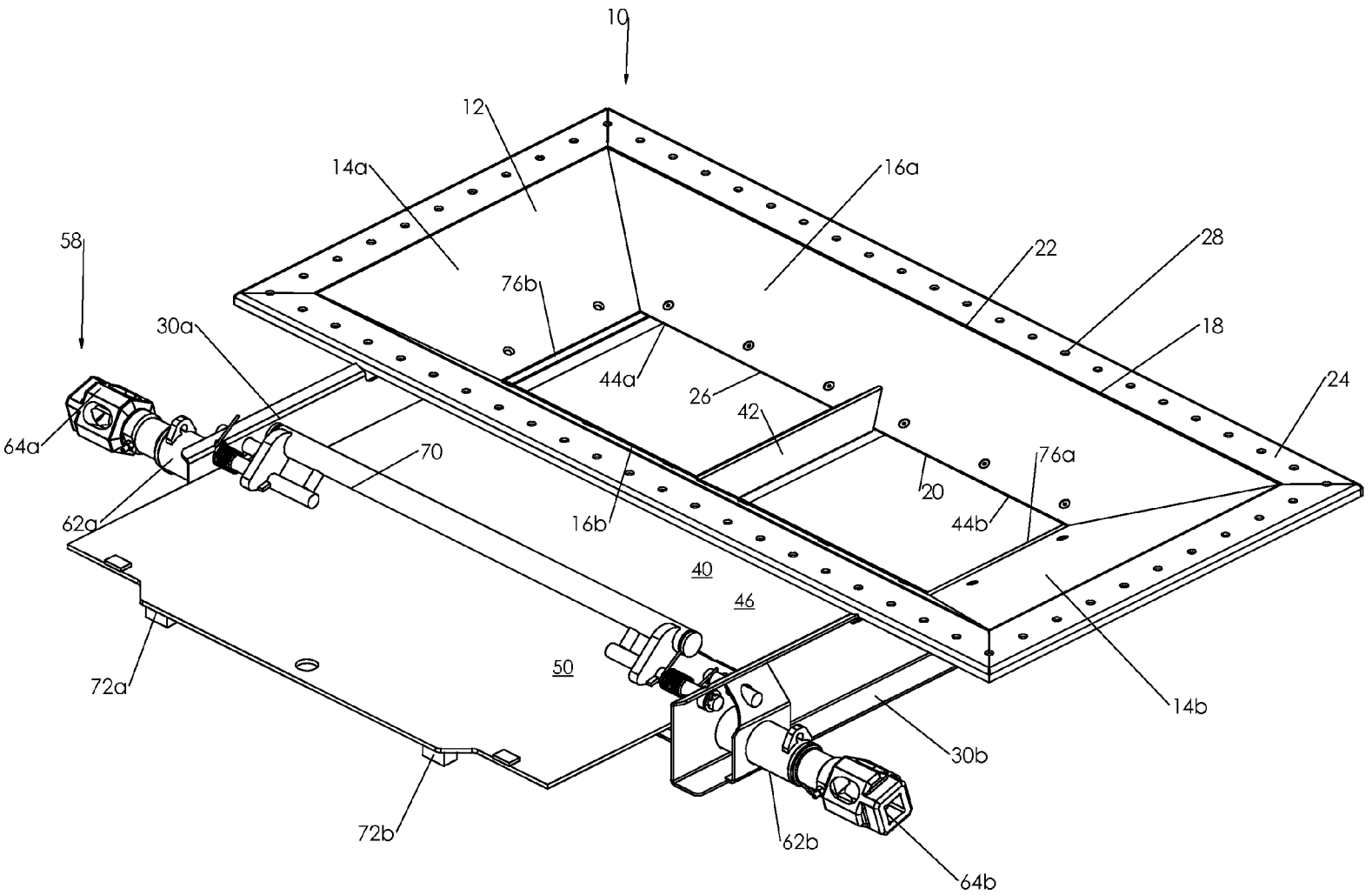
FIG. 14 is a perspective view of the gate assembly of FIG. 1 showing the door in an open position.

Referring to FIG. 7, door 40 is generally Z-shaped and includes a lower section 46, a middle section 48 joined to the lower section 46, and an upper section 50 that is joined to the middle section 48 and spaced vertically above the lower section 46. Referring to FIG. 13, lower section 46 has top and bottom surfaces 52*a* and 52*b*, middle section 48 has top and bottom surfaces 54*a* and 54*b*, and upper section 50 has top and bottom surfaces 56*a* and 56*b*. The bottom surface 52*b* of lower section 46 is supported by rails 34*a-c* (FIG. 8), and the bottom surface 56*b* of upper section 50 is supported by rails 36*a-c* (FIG. 3). The door 40 moves between the closed position shown in FIG. 1, in which the lower section 46 blocks the hopper and bottom openings 20 and 33, and the open position shown in FIG. 14, in which cargo from the hopper to which the gate assembly 10 is mounted discharges through the hopper and bottom openings 20 and 33. As shown in FIG. 6, there are two openings 57*a* and 57*b* in the middle section 48 to allow any debris that accumulates on the top surface 54*a* of the middle section 48 to pass through the door 40.

Referring again to FIG. 13, the lower and upper sections 46 and 50 of the door 40 are both generally planar and horizontal such that they are parallel. The middle section 48 extends upward at an angle from the lower section 46 such that there is an angle X between the sections. The upper section 50 extends away at an angle from the middle section 48 such that there is an angle Y between the sections. Each of the angles X and Y is preferably between approximately 90 to 150 degrees, and is most preferably between approximately 125 to 135 degrees. However, it is within the scope of the invention for the angles X and Y to be any suitable number of degrees. When the door 40 is in the closed position shown in FIG. 1, the lower section 46 is positioned below the side and end walls 14*a-b* and 16*a-b* and the upper section 50 extends away from the side and end walls 14*a-b* and 16*a-b* such that a portion of the upper section 50 intersects a vertical plane that does not intersect the side or end walls 14*a-b* and 16*a-b*. Due to the length and orientation of the middle section 48, the bottom surface 56*b* of the upper section 50 is vertically spaced above the top and bottom surfaces 52*a* and 52*b* of the lower section 46, as shown in FIG. 13. Preferably, the lower and upper sections 46 and 50 are vertically spaced a distance D that is between approximately 2 to 4 inches, and most preferably approximately 2.5 inches. However, it is within the scope of the invention for the lower and upper sections 46 and 50 to be vertically spaced any suitable distance.

Referring to FIG. 6, door 40 is moveable between its open and closed positions via a drive mechanism 58. The drive mechanism 58 includes a shaft 60 that rotates within and is supported by bearings (not shown) positioned within sleeves 62*a* and 62*b* that are joined to side frame members 30*a* and 30*b*, respectively. Sockets 64*a* and 64*b* are joined to the outer ends of shaft 60 for engaging a tool to rotate shaft 60. Gear pinions 66*a*' and 66*b* are mounted on shaft 60. Door 40 includes two racks 68*a* and 68*b* each mounted on the bottom surface 56*b* of upper section 50. Racks 68*a* and 68*b* are engaged by pinions 66*a* and 66*b*, respectively. As shaft 60 rotates, pinions 66*a* and 66*b* engage racks 68*a* and 68*b* to move door 40 in a direction that is perpendicular to shaft 60. A locking mechanism 70, shown in FIG. 1, is joined to and extends between side frame members 30*a* and 30*b* for preventing unwanted motion of door 40, as described in U.S. Pat. No. 7,171,907. As shown in FIGS. 3 and 6, stops 72*a-b* and 74*a-b* are mounted on the bottom surface 56*b* of upper section 50 to limit movement of door 40. Stops 72*a-b* (FIG. 3) abut end frame member 32*c* when the door is in its closed position, and stops 74*a-b* (FIG. 6) jam against pinion gears 66*a* and 66*b*, respectively, when the door is in its open position.

Referring to FIG. 11, a seal 76*a* is mounted to the lower edge of side wall 14*b* for preventing cargo from leaking out of the gate assembly 10 between the door 40 and side wall 14*b*. The seal 76*a* is clamped between the side wall 14*b* and a mounting bar 77*a* joined to the side wall 14*b* with a plurality of fasteners one of which is shown as 77*b*. A similar seal 76*b* (FIG. 5) is mounted to side wall 14*a* in a similar manner. A seal 78, shown in FIG. 10, is mounted to the lower edge of end wall 16*a* for preventing cargo from leaking out of the gate assembly 10 between the door 40 and end wall 16*a*, and a seal 80, shown in FIG. 12, is mounted to the lower edge of end wall 16*b* for preventing cargo from leaking out of the gate assembly 10 between the door 40 and end wall 16*b*. The seal 78 is clamped between the end wall 16*a* and a mounting bar 79*a* joined to the end wall 16*a* with a plurality of fasteners one of which is shown as 79*b*. The seal 80 is clamped between the end wall 16*b* and a mounting bar 81*a* joined to the end wall 16*b* with a plurality of fasteners one of which is shown as 81*b*. As shown in FIG. 12, the angle X between the lower and middle sections 46 and 48 of door 40 is preferably selected to provide sufficient clearance between the door 40 and the fasteners 81*b* securing mounting bar 81*a* and seal 80 to end wall 16*b*. There is also a seal 82 mounted to second end frame member 32*b* beneath door 40. The seal 82 is clamped between end frame member 32*b* and a mounting bar 84*a* joined to end frame member 32*b* with a plurality of fasteners one of which is shown as 84*b*. Seal 82 prevents material from leaking between door 40 and end frame member 32*b*.

Figure 5:
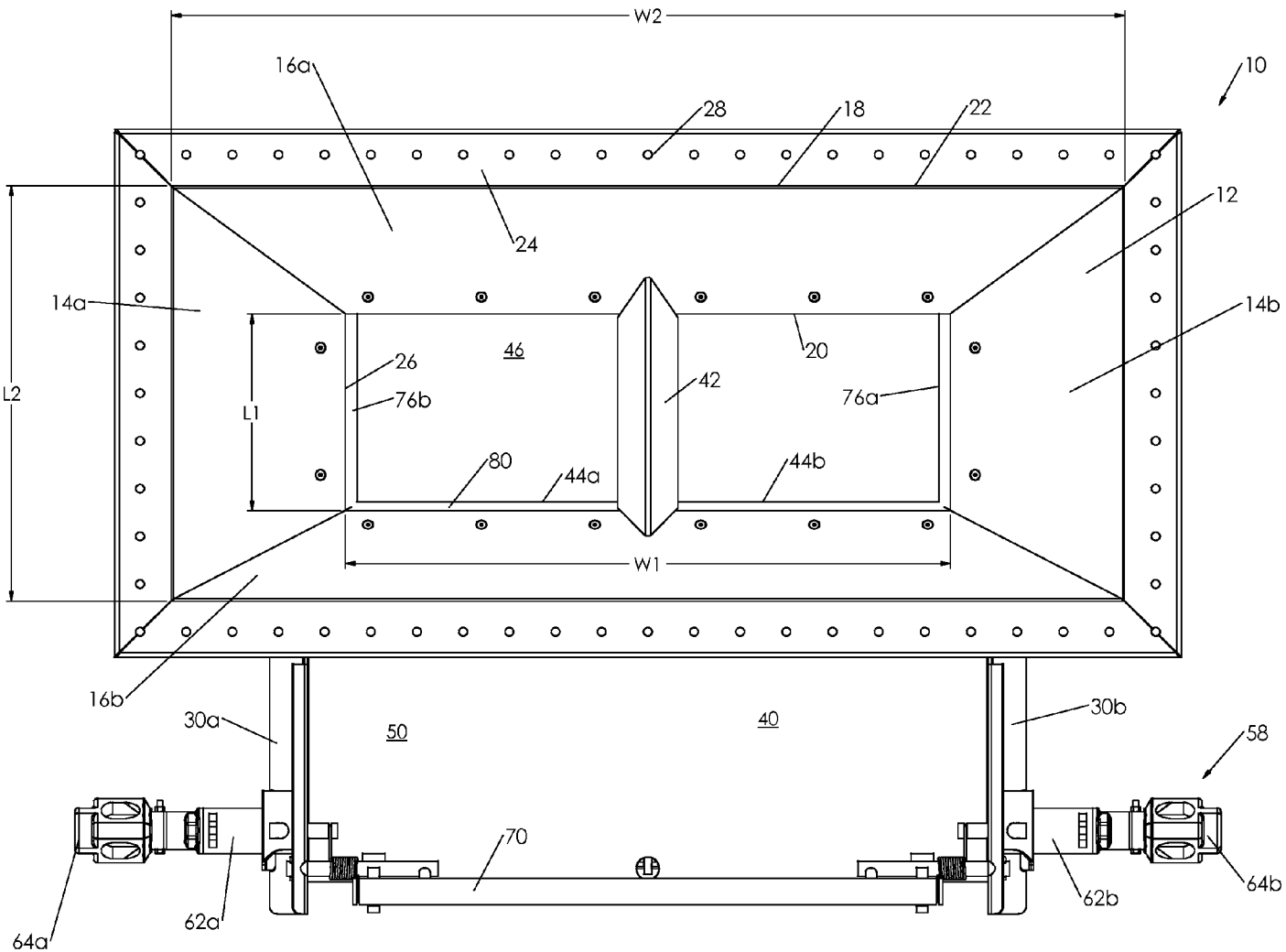
FIG. 5 is a top plan view of the gate assembly shown in FIG. 1.

Referring to FIG. 5, the hopper opening 20 preferably has a width W1, or the distance between the side walls 14*a* and 14*b* at the lower edge 26, of between approximately 36 to 54 inches, and most preferably approximately 40 inches. The hopper opening 20 preferably has a length L1, or the distance between the end walls 16*a* and 16*b* at the lower edge 26, of between approximately 10 to 25 inches, and most preferably approximately 13 inches. However, it is within the scope of the present invention for the gate assembly 10 to have a hopper opening 20 with different dimensions. The top opening 18 preferably has a width W2, or the distance between the side walls 14*a* and 14*b* at the upper edge 22, of between approximately 54 to 74 inches, and most preferably approximately 63 inches. The top opening 18 preferably has a length L2, or the distance between the end walls 16*a* and 16*b* at the upper edge 22, of between approximately 20 to 35 inches, and most preferably approximately 27.25 inches. The top opening 18 preferably has a length and width that permits the gate assembly 10 to be used with a conventional cement hopper car. However, it is within the scope of the present invention for the gate assembly 10 to have a top opening 18 sized such that the gate assembly 10 may be used with other types of hopper cars.

Figure 2:
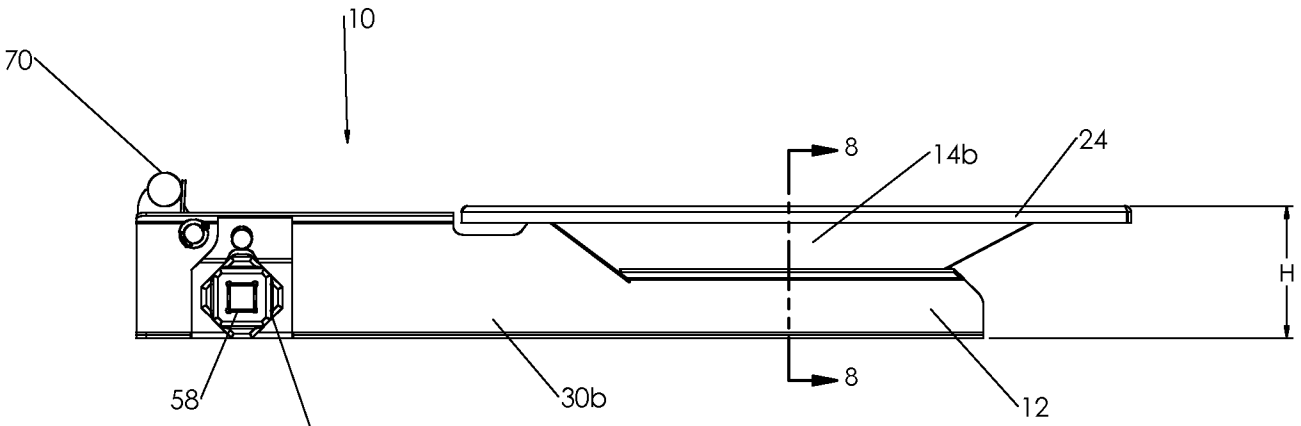
FIG. 2 is a side elevational view of the gate assembly shown in FIG. 1.

Referring to FIG. 8, the bottom opening 33 has a width W3, or the distance between frame members 30*a* and 30*b*, of between approximately 40 to 48 inches, and most preferably approximately 45 inches. Referring to FIG. 7, the bottom opening 33 has a length L3, or the distance between frame members 32*a* and 32*b*, of between approximately 11 to 25 inches, and most preferably approximately 16.5 inches. The bottom opening 33 preferably has a length and width that permit the gate assembly 10 to be unloaded with a conventional cement hopper car unloading boot such that the gate assembly 10 does not need to be modified for unloading with such a boot. However, it is within the scope of the invention for the gate assembly 10 to have a bottom opening 33 with different dimensions. The frame 12 has a height H, shown in FIG. 2, that is preferably between approximately 4.5 to 9 inches, and most preferably approximately 6.875 inches. The height H of the frame 12 is preferably such that when the gate assembly 10 is mounted to a conventional hopper car, there is sufficient clearance between the bottom of the gate assembly 10 and the rails over which the car travels for allowing a hydraulic fracturing sand unloading conveyor (not shown) to extend underneath the gate assembly 10. In this position, cargo can fall on the conveyor when the door 40 is in its open position.

The height H of frame 12 is less than the height of a conventional hopper car gate due to the Z-shape of door 40. Since door 40 has an upper section 50 that is vertically spaced above a lower section 46, the drive mechanism 58 of gate assembly 10, which engages the upper section 50, is raised relative to the drive mechanism of a conventional hopper car gate assembly. Raising the drive mechanism 58 decreases the height H of the gate assembly 10 relative to a conventional hopper car gate assembly, which creates more clearance between the bottom of the gate assembly 10 and the rails over which the car travels. The Z-shape of door 40 also increases the structural rigidity of the door 40 to prevent flexing or deformation of the door 40 when cargo is loaded in the car to which the gate assembly 10 is mounted. Because the door 40 has increased structural rigidity over a conventional planar hopper car gate door, the weight of portions of the frame 12 supporting the door 40 may be reduced lower than what would otherwise be necessary if the door 40 was planar. For instance, the weight of second end frame member 32*b* may be reduced lower than what would be necessary to support door 40 if it was planar.

In operation, with the gate assembly 10 mounted on a hopper car (not shown) and the door 40 in its closed position, the hopper to which the gate assembly 10 is mounted is filled with cargo. The cargo is discharged from the hopper through the gate assembly 10 when an operator moves door 40 from its closed position to its open position by engaging one of sockets 64*a* and 64*b* with an opening tool and rotating the socket 64*a* or 64*b*. Rotation of one of sockets 64*a* and 64*b* causes shaft 60 and pinions 66*a* and 66*b* to rotate. As the pinions 66*a* and 66*b* rotate, they engage racks 68*a* and 68*b* on the bottom of door 40 and cause the door 40 to move to its open position. With the door 40 in its open position, cargo contained within the hopper discharges through the hopper and bottom openings 20 and 33 of the gate assembly 10.

While a preferred embodiment of gate assembly in accordance with the present invention is described above and shown in the drawings, various alternative embodiments are within the scope of the present invention. For example, the door 40 may have a radius between the lower and middle sections 46 and 48, and/or a radius between the middle and upper sections 48 and 50 such that there are gradual transitions between the sections. It is also within the scope of the invention for the middle section 48 of door 40 to have two portions which are positioned at an angle with respect to each other. For example, the middle section 48 may have a first portion that extends from lower section 46 at a first angle (e.g., 90 degrees), and a second portion that extends from the first portion at a second angle (e.g., 135 degrees) and that forms a third angle (e.g., 135 degrees) with the upper section 50. In addition, other drive mechanisms besides the drive mechanism 58 with shaft 60 and gears 66*a-b* are within the scope of the present invention, and the door 40 may have a different structure besides racks 68*a-b* to engage the drive mechanism. It is also within the scope of the present invention to modify door 40 so that the upper section 50 consists of strips that are operable to be engaged by the drive mechanism 58.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A hopper car gate assembly for discharging cargo from a hopper car, comprising:

a frame comprising opposed side walls coupled with opposed end walls, wherein said frame presents top and bottom openings;

a door comprising a lower section comprising a top surface and a bottom surface that is supported by said frame, a middle section that is joined to and extends upward from said lower section, and an upper section that is joined to and extends away from said middle section, wherein said upper and lower sections are vertically spaced, wherein said upper and lower sections are generally parallel, wherein said middle section is positioned at an angle with respect to each of said upper and lower sections, and wherein said door is moveable between a closed position in which said lower section blocks said bottom opening and an open position in which cargo can exit through said bottom opening; and a drive mechanism that engages said upper section of said door to move said door between its closed and open positions.

2. The gate assembly of claim 1, wherein said upper section of said door comprises a bottom surface and a rack mounted on said bottom surface, and wherein said drive mechanism comprises a drive shaft supported by said frame and a gear mounted on said drive shaft that engages said rack.

3. The gate assembly of claim 2, wherein said bottom surface of said upper section is vertically spaced from said top surface of said lower section.

4. The gate assembly of claim 1, wherein when said door is in its closed position said lower section is positioned below said side and end walls and said upper section extends away from said side and end walls such that at least a portion of said upper section intersects a vertical plane that does not intersect said side or end walls.

5. The gate assembly of claim 1, wherein said frame comprises:

side frame members each supporting one of said side walls;

first, second, and third end frame members each extending between and joined with said side frame members;

a first rail extending between and joined with said first and second end frame members, wherein said first rail supports said lower section of said door; and a second rail joined to said third end frame member for supporting said upper section of said door.

6. The gate assembly of claim 5, wherein said side and end walls comprise an upper edge surrounding said top opening and a lower edge surrounding a hopper opening, and said bottom opening is defined by said side frame members and said first and second end frame members.

7. The gate assembly of claim 6, further comprising a rail cover extending between and joined with said end walls, wherein said rail cover is positioned above said first rail, and wherein said rail cover divides said hopper opening into first and second sections.

8. The gate assembly of claim 1, further comprising a flange joined with said side and end walls adjacent said top opening, wherein said flange is adapted to be joined to the hopper car.

9. The gate assembly of claim 1, wherein said bottom opening has a width of between approximately 40 to 48 inches and a length of between approximately 11 to 25 inches, and said top opening has a width of between approximately 54 to 74 inches and a length of between approximately 20 to 35 inches.

10. The gate assembly of claim 9, wherein said bottom opening has a width of approximately 45 inches and a length of approximately 16.5 inches, and said top opening has a width of approximately 63 inches and a length of approximately 27.25 inches.

11. The gate assembly of claim 9, wherein said frame has a height of between approximately 4.5 to 9 inches.

12. The gate assembly of claim 11, wherein said frame has a height of approximately 6.875 inches.

13. The gate assembly of claim 1, wherein said upper and lower sections of said door are vertically spaced between approximately 2 to 4 inches.

14. The gate assembly of claim 13, wherein said upper and lower sections of said door are vertically spaced approximately 2.5 inches.

15. A hopper car gate assembly for discharging cargo from a hopper car, comprising:

a frame comprising opposed side walls coupled with opposed end walls, wherein said frame presents top and bottom openings;

a door comprising upper and lower sections that are vertically spaced, wherein said upper section is planar, wherein said lower section is supported by said frame, wherein said door is moveable between a closed position in which said lower section blocks said bottom opening and an open position in which cargo can exit through said bottom opening, wherein when said door is in its closed position said upper section does not block any portion of the bottom opening, and wherein when said door is in its closed position said lower section is positioned below said side and end walls and said upper section extends away from said side and end walls such that at least a portion of said upper section intersects a vertical plane that does not intersect said side or end walls; and a drive mechanism that engages said upper section of said door to move said door between its closed and open positions.

16. The gate assembly of claim 15, wherein said upper section of said door comprises a bottom surface and a rack mounted on said bottom surface, and wherein said drive mechanism comprises a drive shaft supported by said frame and a gear mounted on said drive shaft that engages said rack.

17. The gate assembly of claim 15, wherein said door comprises a middle section that is joined to and extends upward from said lower section, and wherein said upper section is joined to and extends away from said middle section.

18. The gate assembly of claim 17, wherein said upper and lower sections of said door are generally parallel, and wherein said middle section is positioned at an angle with respect to each of said upper and lower sections.

19. A hopper car gate assembly for discharging cargo from a hopper car, comprising:

a frame comprising opposed side walls coupled with opposed end walls, wherein said frame presents top and bottom openings;

a door comprising an upper section comprising top and bottom surfaces and a lower section comprising top and bottom surfaces, wherein said upper section is generally planar and horizontal, wherein said lower section is generally planar and horizontal, wherein said bottom surface of said upper section is vertically spaced above said bottom surface of said lower section, wherein said bottom surface of said lower section is supported by said frame, and wherein said door is moveable between a closed position in which said lower section blocks said bottom opening and an open position in which cargo can exit through said bottom opening; and a drive mechanism that engages said bottom surface of said upper section of said door to move said door between its closed and open positions.

20. The gate assembly of claim 19, wherein said door comprises a rack mounted on said bottom surface of said upper section, and wherein said drive mechanism comprises a drive shaft supported by said frame and a gear mounted on said drive shaft that engages said rack.

21. The gate assembly of claim 19, wherein said door comprises a middle section that is joined to and extends upward from said lower section, and wherein said upper section is joined to and extends away from said middle section.

22. The gate assembly of claim 21, wherein said upper and lower sections of said door are generally parallel, and wherein said middle section is positioned at an angle with respect to each of said upper and lower sections.

23. A hopper car gate assembly for discharging cargo from a hopper car, comprising:

a frame comprising opposed side walls coupled with opposed end walls, wherein said frame presents top and bottom openings;

a door comprising a lower section comprising a top surface and a bottom surface that is supported by said frame, a middle section that is joined to and extends upward from said lower section, and an upper section that is joined to and extends away from said middle section, wherein said upper and lower sections are vertically spaced, and wherein said door is moveable between a closed position in which said lower section blocks said bottom opening and an open position in which cargo can exit through said bottom opening; and a drive mechanism that engages said upper section of said door to move said door between its closed and open positions, wherein said drive mechanism does not engage said middle section and said lower section.

24. The gate assembly of claim 23, wherein said upper and lower sections are generally parallel, and wherein said middle section is positioned at an angle with respect to each of said upper and lower sections.

25. The gate assembly of claim 23, wherein said upper section is planar, and wherein when said door is in its closed position said upper section does not block any portion of the bottom opening.

26. The gate assembly of claim 23, wherein said upper section is generally planar and horizontal, and wherein said lower section is generally planar and horizontal.

* * * * *